United States Patent [19]

Gravesteyn

[11] 3,967,436

[45] July 6, 1976

[54] CAPSULATING MACHINE

[75] Inventor: Elbert Gravesteyn, Leiderdorp, Netherlands

[73] Assignee: Heineken Technisch Beheer B.V., Netherlands

[22] Filed: Apr. 16, 1975

[21] Appl. No.: 568,457

[52] U.S. Cl. ..... 53/315

[51] Int. Cl.[2] ..... B65B 7/28; B67B 3/00

[58] Field of Search ..... 53/313, 314, 315, 316, 53/319, 367, 368

[56] References Cited

UNITED STATES PATENTS

| | | | |
|---|---|---|---|
| 2,166,784 | 7/1939 | Pommer | 53/314 |
| 2,835,963 | 5/1958 | Drennan et al. | 53/314 X |
| 3,012,388 | 12/1961 | Stover | 53/315 |
| 3,550,240 | 12/1970 | Bresley et al. | 53/313 UX |
| 3,874,147 | 4/1975 | Zetterberg | 53/315 X |

*Primary Examiner*—Travis S. McGehee
*Assistant Examiner*—Horace M. Culver
*Attorney, Agent, or Firm*—Eugene E. Geoffrey, Jr.

[57] ABSTRACT

It is the object of the present invention to provide a machine for applying covers or caps on container closures such as the bung hole closure of beer casks or the like, there being mounted a feed chute pivotally mounted about a horizontal cross shaft for the caps to be handled, and having a pressure member at its free end with which the caps are pressed in a single operation in their end position on and about the closures.

The feed chute is spring-loaded to allow automatic passage of the pressure member over the cask edge which lies above the level of the closure, by vertical strokes over the cask edge.

3 Claims, 4 Drawing Figures

FIG. 3
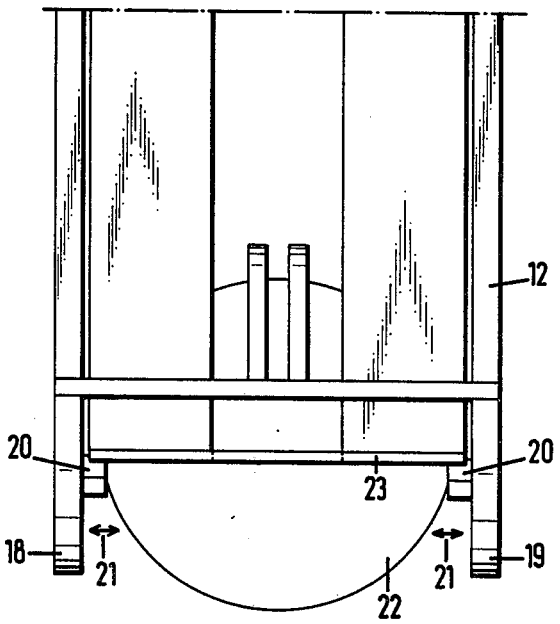
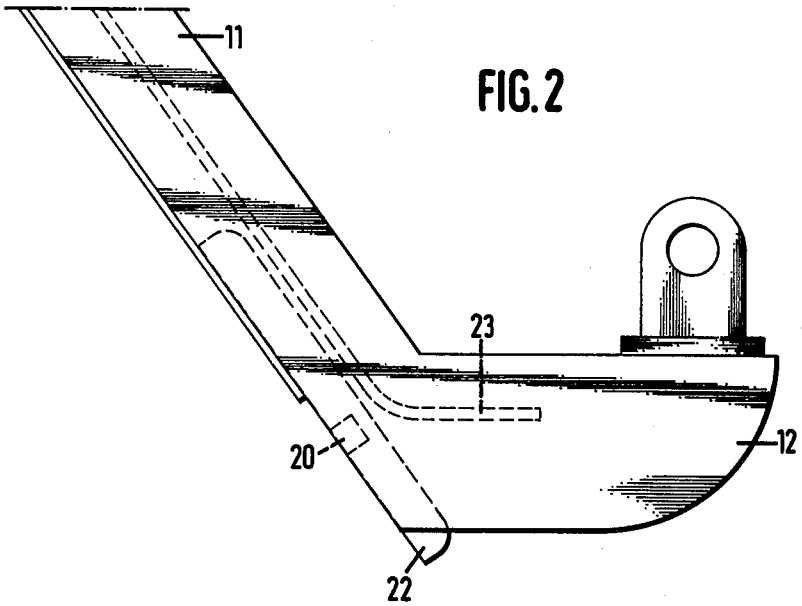
FIG. 2

CAPSULATING MACHINE

The invention relates to a capsulating machine for applying covers or caps on container closures, such as the bung hole closure of beer casks or the like, which includes a sloping feed chute for the caps to be processed, and a pressure member for pressing a cap on the closure of a subjacent container positioned on a conveyor.

In known capsulating machines the inclined feed chute for the caps or capsules to be processed is stationary. By a separate pressure member the caps are removed one after the other from the chute and pressed on the neck of a container to close the opening therein as the container passes underneath the pressure device.

In a following station, which is not further described, the caps may be tightened so that the containers cannot be continuously advanced.

It is an object of the invention to apply covers or caps on sealed closures, such as in the case of beer casks.

To this effect the capsulating machine according to the invention is so constructed that the feed chute is pivotally mounted about a horizontal shaft in a vertical plane, which shaft is mounted in the frame of the machine. The chute carries a dispensing end which includes a pressure member integral therewith and adapted to move vertically over the edge and the closure and apply automatically a cap to a closure on a container passing thereunder at continuous speed. Owing to the swivelling construction of the feed chute, it is evident that it occupies such a position upon the closure that a cap present at the dispensing end is contacted by the edge of the closure and by the continuously advancing movement of the container is automatically drawn from the dispensing end and subsequently is pressed on the closure by the pressure member connected to the dispensing end.

Figure 1:
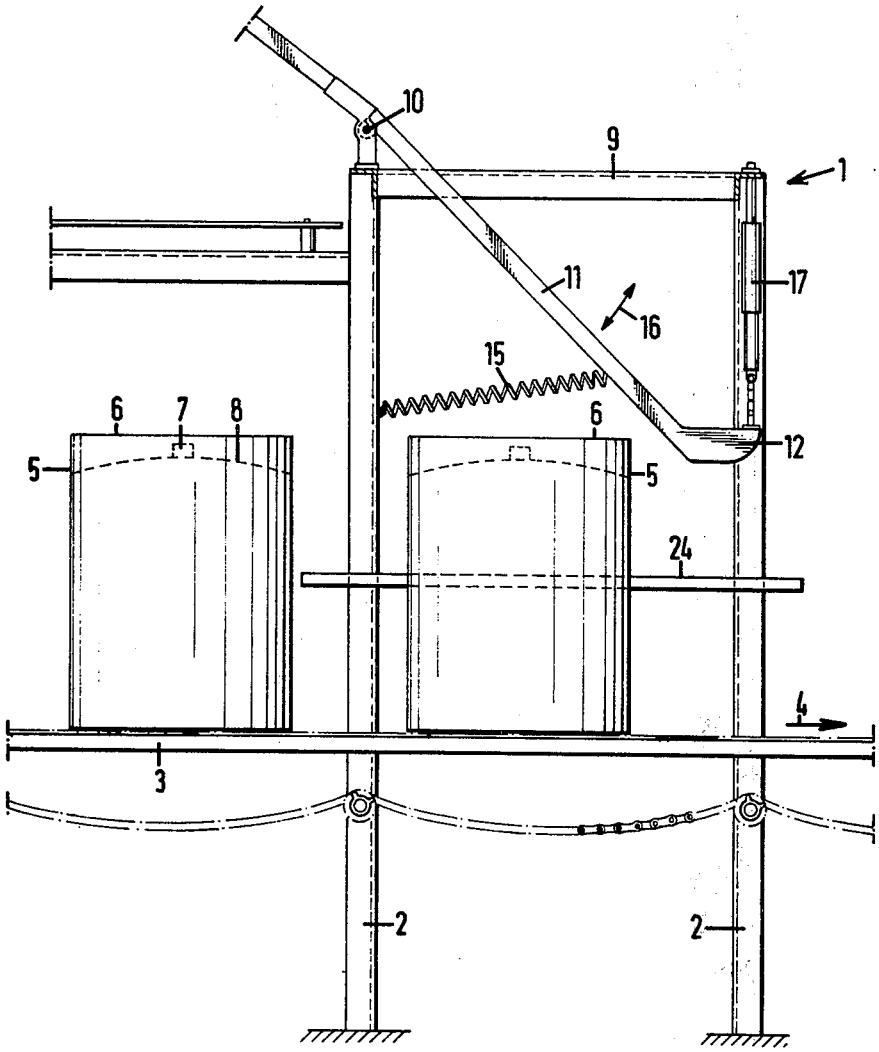

A non-limitative embodiment of the invention will now be described with reference to the drawings wherein FIG. 1 is a partly diagrammatic side view, of the capsulating machine;

FIG. 2 a side view of the dispensing end of the feed chute at enlarged scale;

FIG. 3 at the same enlarged scale, a top view of the dispensing end and

Figure 4:
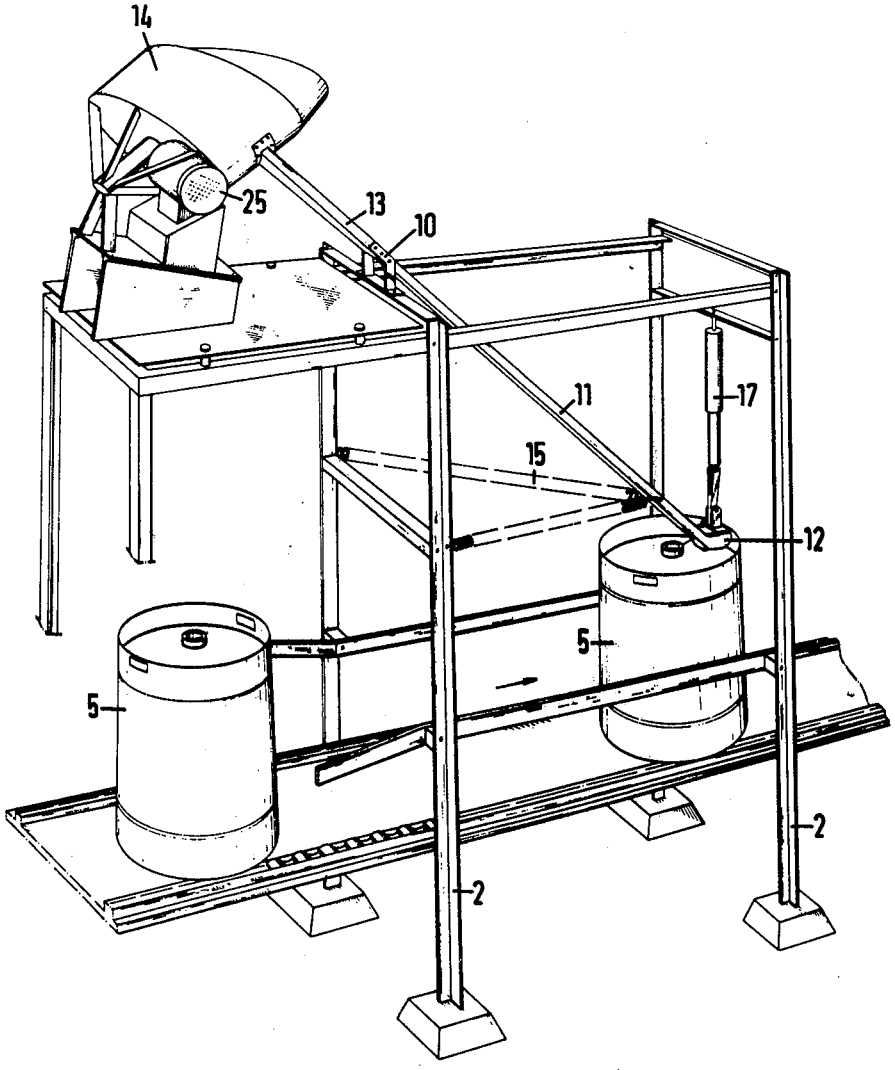

FIG. 4 a perspective view of the capsulating machine.

The capsulating machine according to the invention has a frame 1 with legs 2 carrying longitudinal girders 3 and a chain conveyor which, in operation, continuously moves in the direction of arrow 4 to transport successive casks, two of which being shown in FIG. 1 and denoted by the numeral 5. The casks are of the modern type, having an upper edge 6 lying at a slightly higher level than the closure 7 on the arched roof 8 of the cask.

On the top girders 9 (only one being visible) of the frame, there is mounted a horizontal shaft 10 which pivotally carries the feed chute 11 for pivotal movement in a vertical plane and about an axis between its ends. In FIG. 1 the chute 11 and the dispensing end 12 with rounded bottom side are in the lowest position.

A hopper 14 is connected to the feed side 13 of the chute (FIG. 4) for feeding the caps to the chute. In the feed hopper there is disposed a stirring member - not shown - which is driven by an electric motor 25. The stirring member is designed to correctly position the caps in the chute. The latter feature is not relevant to the invention and, consequently will not be described.

Due to springs 15 the feed chute 11 with its dispensing end will always remain in contact successively with the front portion of the cask edge 6, the roof 8, the closure 7, again the roof 8 and the hind portion of the edge 6 and following the thus formed path, the chute will follow the direction shown by the double arrow 16. To avoid springing, the dispensing end is coupled to a shock absorber 17.

In order to avoid the possibility that the caps may be released without resistance one after the other from the dispensing end 12, there is mounted on each side wall 18, 19 thereof (see FIGS. 2 and 3) a positioning cam 20 which may be yielding or springing according to double arrows 21, and each time it passes a cap 22, which after positioning on the closure by the pressure member 23 on the dispensing end, can be pressed on the closure.

The pressure member 23 functions as a sealing means (see FIG. 2).

In order to move the casks and also their closures in the correct position underneath the dispensing end and the pressure member, the frame is also provided with a centering guide 24 adjustable to the cask diameter.

Owing to the automatic operation of the capsulating machine according to the invention, which has a simple construction, the investment costs, maintenance costs and labour costs are reduced, a high yield is provided.

It will be clear that constructive modifications are possible within the scope of the invention.

I claim:

1. A capsulating machine for applying covers or caps to the opening of the neck portion of a container, such as the bung hole closure on beer casks and the like comprising a frame, a sloping feed chute for said caps pivotally carried by said frame for movement in a vertical plane, a cap dispenser carried at the end of said chute, means on said frame for guiding said containers beneath said cap dispenser and with said opening in alignment with said dispenser, spring loaded positioning cams for retaining the leading cap in position in said dispenser, means for normally retaining said dispenser at a position below said container opening, said chute functioning as a camming means to raise the dispenser upon engagement by a container neck and force the leading cap into engagement therewith and prevent displacement of the leading cap upon contacting a container surface of greater size than said neck and means within said dispenser to effect pressure engagement of said cap with said neck and urge it into tight engagement therewith.

2. A capsulating machine according to claim 1 wherein said chute is pivoted intermediate the ends thereof.

3. A capsulating machine according to claim 1 including shock absorbing means disposed between said dispenser and said frame.

* * * * *